US005347787A

United States Patent [19]

Gavin

[11] Patent Number: 5,347,787

[45] Date of Patent: Sep. 20, 1994

[54] UNIVERSAL SPACER FOR CONCRETE REINFORCEMENT RODS

[76] Inventor: Norman W. Gavin, 2545 Ridge Rd., North Haven, Conn. 06473

[21] Appl. No.: 112,011

[22] Filed: Aug. 25, 1993

[51] Int. Cl.[5] ..... E04C 5/16

[52] U.S. Cl. ..... 52/677; 52/689; 248/74.3

[58] Field of Search ..... 248/74.1, 74.2, 74.3, 248/68.1, 50, 72, 67.5; 52/677, 687, 689, 684

[56] References Cited

U.S. PATENT DOCUMENTS

| | | | |
|---|---|---|---|
| 3,300,930 | 1/1967 | Weise | 52/309 |
| 3,348,347 | 10/1967 | Berry | 52/309 |
| 3,694,989 | 10/1972 | Oliver et al. | 52/678 |
| 3,783,574 | 1/1974 | Cennerelli | 52/687 |
| 3,913,187 | 10/1975 | Okuda | 248/74.3 X |

FOREIGN PATENT DOCUMENTS

| | | | |
|---|---|---|---|
| 352438 | 1/1990 | European Pat. Off. | 248/74.1 |
| 1270774 | 6/1968 | Fed. Rep. of Germany | 52/687 |

*Primary Examiner*—Carl D. Friedman
*Assistant Examiner*—Creighton Smith
*Attorney, Agent, or Firm*—Robert A. Seemann

[57] ABSTRACT

A single unit, stiff and strong plastic molded wheel spacer for a reinforcement rod used in concrete is split into two sections connected by an integral hinge at one end and fastened together by a ratchet assembly at the other end. The rod is gripped at the center of the wheel by a pair of saddles, one on each section. A finger attached to one of the sections between the saddle and hinge prevents the rod from moving past the saddle to the hinge.

11 Claims, 3 Drawing Sheets

UNIVERSAL SPACER FOR CONCRETE REINFORCEMENT RODS

FIELD OF THE INVENTION

This invention relates to static structure spacer-positioners, more specifically to a spacer for a rod used for reinforcement of concrete, in which a spacer of single unit unitary construction, provides support unyieldingly normal to a rod, for any one of a variety of diameter rods, as a wheel or chair in concrete item construction.

DESCRIPTION OF THE PRIOR ART

U.S. Pat. No. 3,300,390 describes a two part spacer chair. The first part is a seat having a front end, a back end, a right side and a left side. The front end has an axially oriented groove between the right and left side for receiving a rod. The back end of the spacer seat consists of a pair of legs which extend rearward of the seat for contacting the shuttering or mold wall.

The right and left sides of the spacer seat each have a series of axially oriented ratchet ridges.

The second part is a U-shaped clip, the legs of which have ratchet ridges on the inner facing sides. The clip is designed to be slipped over the seat containing the rod and pressed down upon the seat until the semicircular inner face of the clip contacts the rod. As the clip progresses down toward the rod, the ratchets on the clip legs and on the seat engage progressively, and prevent the clip from backing off from the seat, thus holding the rod in the opening formed between the seat and the clip.

The design presents some difficulties.

Given that a plurality of the spacer chairs are to be installed on a rod, each of the spacers must be carefully oriented during attachment to the rod so that the rearward legs which are to contact the mold are in the same direction. If the spacer chairs described are to be used to space a rod from adjoining walls, two sets of this design must be installed, each set carefully oriented for the wall it is intended to contact. Thus installation requires considerable care and time.

The correct spacer seat and clip must be selected with an opening that closely matches the diameter of the rod, or resulting radial spaces between the rod and spacer will permit the spacer to cock, that is tilt obliquely with respect to the axis of the rod and therefore with respect to the wall.

Cocking of a spacer among a plurality of spacers mounted on a rod will cause uneven spacing and weak areas of support.

To avoid this problem an inventory of various sizes should be kept to accommodate the range of rods usually in use in concrete item manufacture, for example for rods from size #3 to #5, or about $\frac{3}{8}''$ to $\frac{5}{8}''$ in diameter.

Unless a spacer grips a rod securely at strategic points about the rod, the spacer will cock on the rod under oblique forces from advancing concrete and from rod shifting with respect to an adjoining wall of the mold.

U.S. Pat. No. 3,348,347 describes two designs.

The first design comprises a semicircular disk with a centrally located, semicircular, axial groove for receiving a rod.

A springy wire loop is axially, pivotally attached by one end of the loop to the disk at one top end of the groove.

The inner face of the opposite end of the groove includes a series of axial slots for receiving the opposite end of the loop for holding a rod down in the groove by the spring action of the wire.

Although the wire closure over the rod is adjustable to several slots to accommodate various size rods, a rod is not held securely enough by this arrangement to prevent cocking of the spacer on the rod. This is because a rod having a smaller diameter than the groove is held between axial line contact somewhere near the bottom of the groove on one side of the rod, and by generally parallel, wrap over, springy line, contact across the bar on the opposite of the rod.

If spacers are made with different diameter grooves so that one may be selected to snugly fit the bottom of a particular diameter rod, the spacer is still likely to cock, due to the springiness of the wire.

Each spacer of a plurality of mounted spacers must be carefully oriented so that all the spacers present their curved portions, not their wire mechanism sides to the mold wall, for reasons explained above.

The second design, a wheel spacer, comprises a disk with a centrally located, semicircular, axial groove for receiving a rod. Access to the groove for installing the disk on a rod is provided by way of an opening in the outer diameter of the spacer.

A pair of inwardly directed, crossed, springy legs, are attached each by one end respectively to each side of the outer margin of the opening.

The spacer is installed on a rod by aligning the opening across the rod and pressing the spacer down so that the rod forces the legs apart and enters into the groove.

An inventory of spacers with various axial openings is required to accommodate various diameter rods. The axial opening is defined by the groove diameter and distance of the bottom ends of the relaxed springy legs from the bottom of the groove. The inventory increases cost for the user, and requires extra care in installation.

The axial opening has to be as close in fit to the rod diameter as possible in order to keep the spacer from flopping over on the rod. Nevertheless, with the closest fit possible, the spacer can still cock over under load because there must be space allowed between the rod seated in the groove and the bottoms of the legs so that the legs are free to clear the rod on their return to the crossed position to close the opening over the rod.

Manufacture of this spacer design requires use of costly plastic that is of relatively low strength. This is because the legs which are substantially thick and structural in nature to keep the spacer on the rod, must also be flexible enough to permit the rod to temporarily spread them apart as it passes between them.

U.S. Pat. No. 3,694,989 describes a wheel having an axially oriented, semicircular, central groove with the radiating ends of the groove extending in parallel legs to the outer edge of the wheel, thereby providing a direct opening from the outer edge to the groove that is as wide as the diameter of the groove.

The inner side of each leg has a series of axially oriented ratchet ridges from the opening near the outer edge down to the ends of the groove. The legs are slightly wider than the wheel.

A separate, locking shoe member has a pair of parallel outer walls containing fingers which slidingly embrace the sides of the legs, and ratchet ridges on the outer walls between the fingers for engaging the ratchets on the inner side of each leg.

The spacer is installed on a rod by slipping it on the rod until the rod contacts the base of the groove, then, while holding the spacer in place, sliding the locking shoe member down the legs and pressing it against the rod. Downward angled, axial fingers on the shoe, which extend in opposite directions from one another, brace against the top of the rod to help steady the spacer against tilting on the rod about a horizontal axis.

This two piece design is costly to make, and takes time and care in the two-step installation on a rod.

Although the shoe closes upon the groove to hold rods of considerably less diameter that the diameter of the groove, the spacer can readily cock on the rod about a vertical axis when a rod diameter less than closely approaches the diameter of the groove. This is due to the spaces that occur between the rod and groove 90 degrees around from the shoe, on each side of the rod.

The wheel has to be carefully rotated on the rod to be in alignment with others on the same rod because the rod, depending on size, is not centered in the wheel, and because the opening in the outer edge of the wheel is wide and would represent a flat in the outer diameter of the wheel when resting against a wall.

U.S. Pat. No. 3,783,574 describes a wheel having radial points emanating from the outer diameter. The points alternate from right and left edges of the disk as seen from the edge of the disk.

The spacer is designed in a single design to mount on different diameter rods. Through the outer diameter there is an opening that is as wide as the diameter of the widest rod that the unit is designed to accommodate. The opening continues into the body of the disk in a series of smaller and smaller holes separated by constrictions, wending its way in a loop close to the circumference of the disk.

The design is mounted on a rod by forcing it on the rod, the rod passing along the loop until the rod lodges in the smallest hole in which it will fit. The spacer is then rotated about the rod in the manner of an eccentric cam in order to select a desired distance to be established by the spacer between the rod and the wall.

Manufacture of this spacer design requires use of costly plastic that is of relatively low strength. This is because the constrictions and holes which are substantially thick and structural in nature to keep the rod in the finally selected hole must be flexible enough to temporarily spread to let the rod through.

The low strength plastic can also yield to let the spacer cock on the rod.

If a plurality of spacers are to be installed on a rod to space it, say from a vertical wall of a mold, the need to rotate each one on the rod to just the same angle as the others is time consuming and difficult in normal working environments, for example; when a worker is wearing gloves, in low light levels, or where several workers are setting rods.

Objects of the present invention include overcoming problems inherent in rod spacers presently used in the art. These include the above problems such as:

need to use a more costly plastic because it must be flexible in thick structural form, tendency of the spacer to cock on the rod due to a requirement that flexible plastic be used, or that there are spaces on opposite sides of the rod between the rod and the spacer, or that the rod is not tightly gripped at sufficient locations about its circumference, labor intensive and inconvenient need to orient spacers each to a same direction or to a same angle about the rod in order to have uniform spacer support for a plurality of mounted spacers along the rod between the rod and a wall or two adjacent walls, labor and inconvenient need to assemble a two part spacer about a rod, need to carry an inventory of different spacers sized to accommodate the range of rod diameters presently used in concrete item construction.

The present invention overcomes the above problems to a great extent.

The present invention is inexpensive to make. A strong plastic that is relatively inexpensive may be used, for example recycled styrene plastic works well. The spacer is of single unit construction which can be molded ready to use.

It is highly resistant to cocking because it adjusts to tightly grip a rod, relatively stiffly, at several areas around the circumference of the rod.

Installation on a rod is quick and simple. The spacer opens wide to slip over a rod. It is then squeezed closed around the rod until it locks up to maximum tightness.

Extra time or care to orient on the rod is unnecessary. The spacer is symmetrical, with no large opening in the outer diameter.

There is no need to carry a large inventory to accommodate rods of different diameters. The spacer is ready to use in one piece, and one size accommodates rods from size #3 to #5 or better.

The spacer can be used as a chair or wheel, for example, against a bottom wall or against adjacent bottom and side walls respectively.

Other objects and advantages of the present invention will become apparent to persons skilled in the art from the ensuing description.

A one piece molded wheel spacer includes a first section having a first end, a second end, an inner side, and a semicircular outer side, a hinge, and a second section having a first end, a second end, an inner side, and a semicircular outer side. The second section is pivotally attached at the first end to the first end of the first section so that a generally wheel shape is formed by the outer sides when the sections are brought together.

The first and second sections include saddle means at their inner sides for gripping a reinforcement rod at the center of the wheel when the sections are brought together on the rod.

A finger attached to the spacer between the saddle and the hinge prevents movement of the rod past the saddle to the hinge.

Means are mounted on the spacer for resisting separation of the second ends of the first and second sections. Preferably the means for resisting separation comprises a ratchet assembly which includes a ratchet arm on one of the first and second sections, and receiving ratchet means on the other section for engaging the ratchet arm.

Means are provided on the ratchet assembly for separating the ratchet arm from engagement with the receiving ratchet means.

BRIEF DESCRIPTION OF THE DRAWINGS

In order that the invention will be more fully comprehended, it will now be described, by way of example, with reference to the accompanying drawings, in which.

DESCRIPTION OF THE PREFERRED EMBODIMENTS

Figure 1:
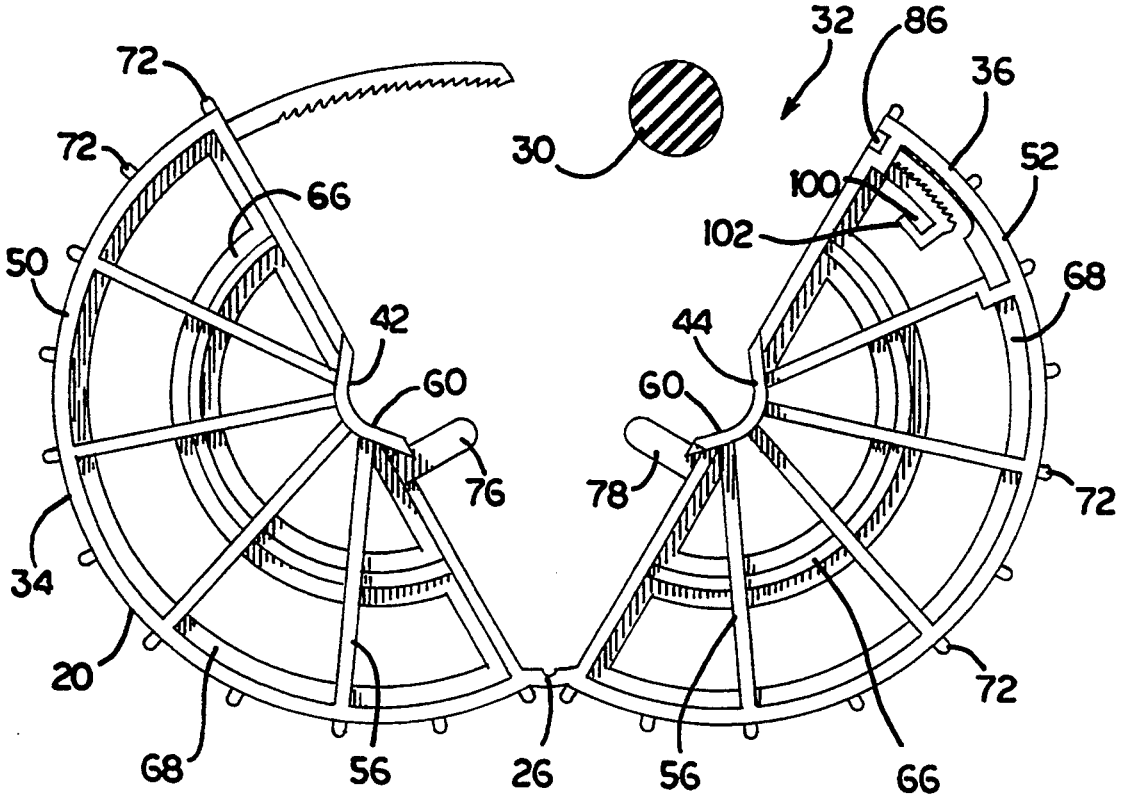
FIG. 1 is a side elevational view of a spacer of the present invention, open to receive a reinforcement rod.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1, spacer 20 which is molded in one piece of a plastic that is selected for strength, stiffness and economy, such as recycled styrene plastic.

The spacer includes integral hinge 26 which is preferably made thin to allow bending of the plastic. The hinge need only be designed to survive up to two or three bend cycles, as it is usually operated through only one cycle in practical use.

The spacer is preferably supplied folded to an open position as shown in FIG. 1, for receiving steel rod 30 for concrete reinforcement, shown in cross section, through opening 32, with only occasional need to pull sections 34 and 36 further apart to allow entrance of the rod.

Saddles 42 and 44 are spaced equally from rims 50 and 52 respectively by generally radial spokes 56 which are wide to resist twisting or bending of the spacer. The inner curve 60 of each saddle is preferably oval or angular so that each saddle will contact a seated rod at two spaced apart locations around the rod.

Reinforcement ring 66 which further resists twist and bend of the spacer is "T" shaped in cross section. Inner margin rib 68 provides additional radial strength.

Axially oriented ribs 72 provide stand-off from the wall or floor of a mold, to keep rim 50 from showing at the surface of a finished concrete product when the mold wall or floor is removed.

Figure 2:
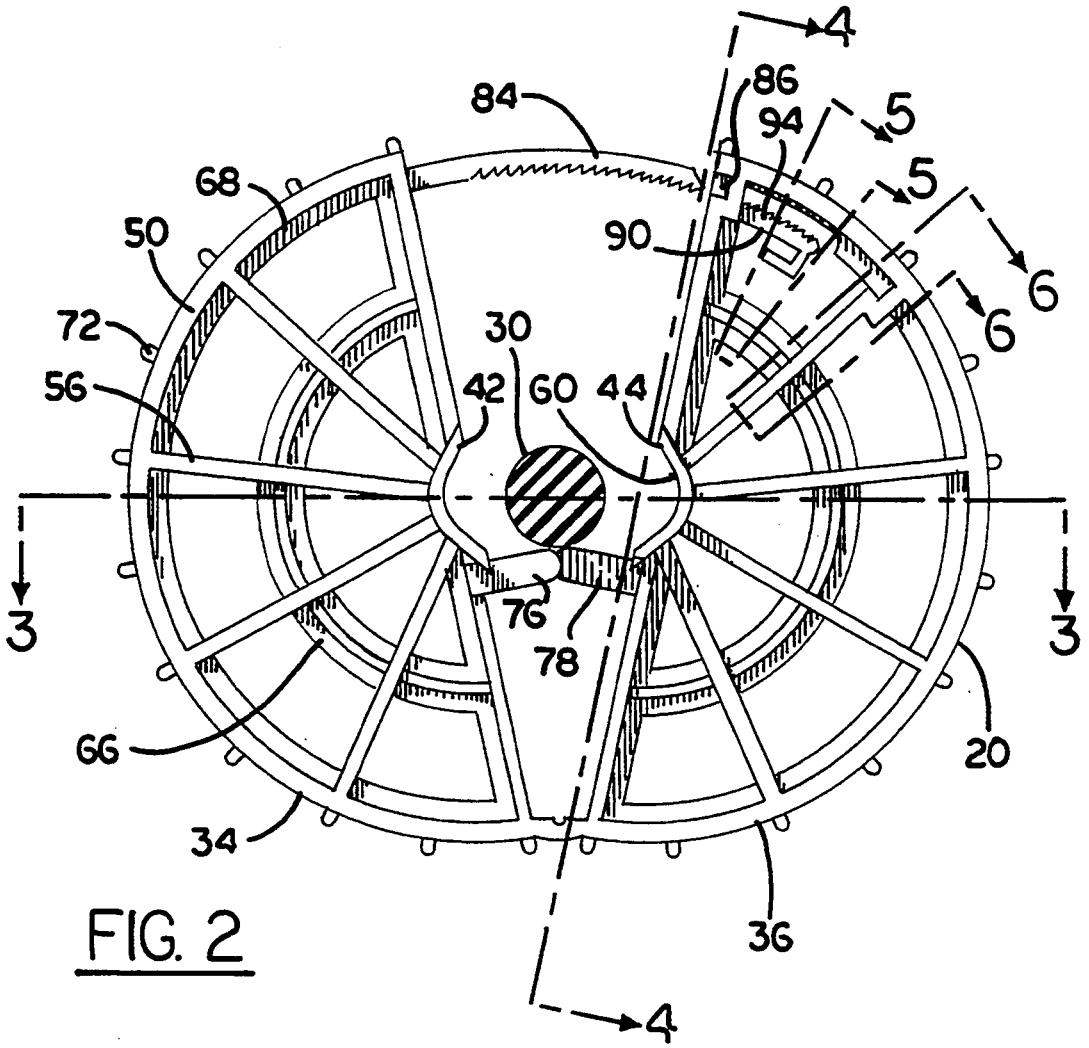
FIG. 2 is a side elevational view of the spacer of FIG. 1 with the spacer fully slipped on the rod and partially closed.
Figure 3:
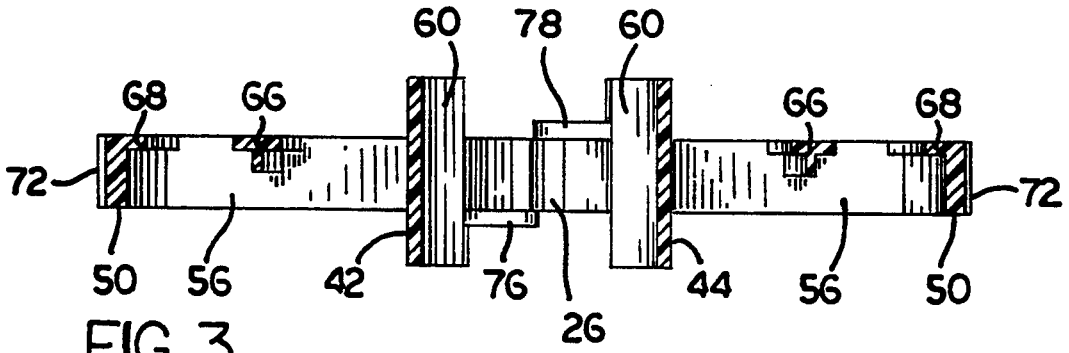
FIG. 3 is a top view of the spacer of FIG. 2, less the rod, taken at 3—3.
Figure 4:
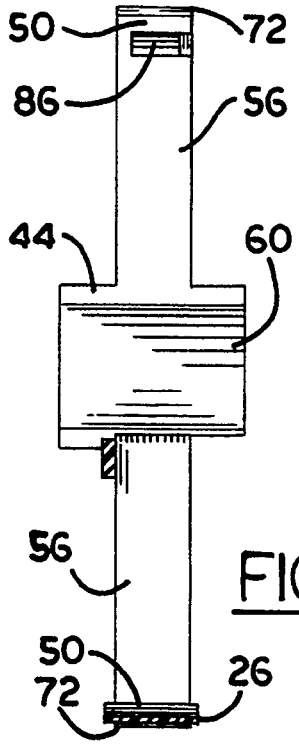
FIG. 4 is a side view of a section or portion of the spacer of FIG. 2, taken at 4—4.

Referring to FIG. 2, and to FIG. 3 showing FIG. 2 viewed at 3—3 less the rod, spacer 20 is slipped on rod 30 until stopped by guide fingers 76 and 78 which position the spacer on the rod for acquisition of the rod by saddles 42 and 44 when sections 34 and 36 are squeezed together. The fingers are therefore preferably close enough to the saddles so that the center of the rod is above the lower edge 64 of inner surface 60 of the saddles when the sections are partially closed, before the saddles acquire the rod.

In FIG. 2 the sections are partially closed about the rod. Ratchet arm 84 is about to enter primary guide hole 86 in order to engage ratchet finger 90.

Figure 5:
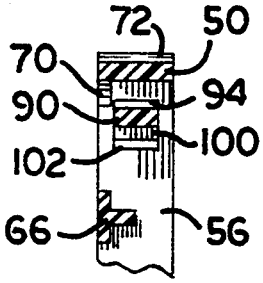
FIG. 5 is a side view of part of a section of the spacer of FIG. 2, taken at 5—5.
Figure 6:
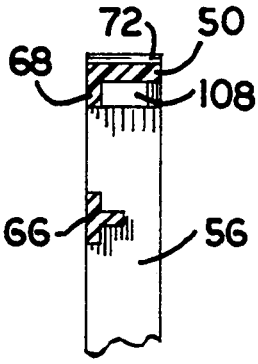
FIG. 6 is a side view of part of a section of the spacer of FIG. 2, taken at 6—6.

FIGS. 1, 4, 5, and 6, show the ratchet and guide holes for receiving the ratchet arm. Ratchet arm enters guide hole 86, and comes into contact with ratchet teeth 94 of ratchet arm 90. In FIG. 5, the ratchet arm passes to the right of and parallel with reduced width portion 70 of inner margin rib 68.

Figure 8:
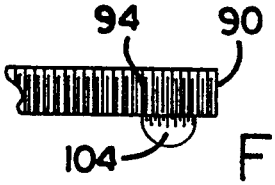
FIG. 8 is a top view of a part of a ratchet finger with draw-back finger grip.

Screw driver slot 100 permits unlocking of the ratchet arm by twisting an inserted screw driver blade clockwise so that it presses down on twist pad 102, drawing ratchet finger just out of engagement with ratchet arm 84. This permits safe removal of the spacer without snapping the stiff plastic. Draw-back finger grip 104, FIG. 8, which extends from twist pad 102 permits unlocking of the ratchet arm by finger pressure without need for a screw driver or other tool.

Secondary guide hole 108 receives the leading tip of the ratchet arm after it passes the ratchet finger, when the spacer is locked on a small diameter rod.

Figure 7:
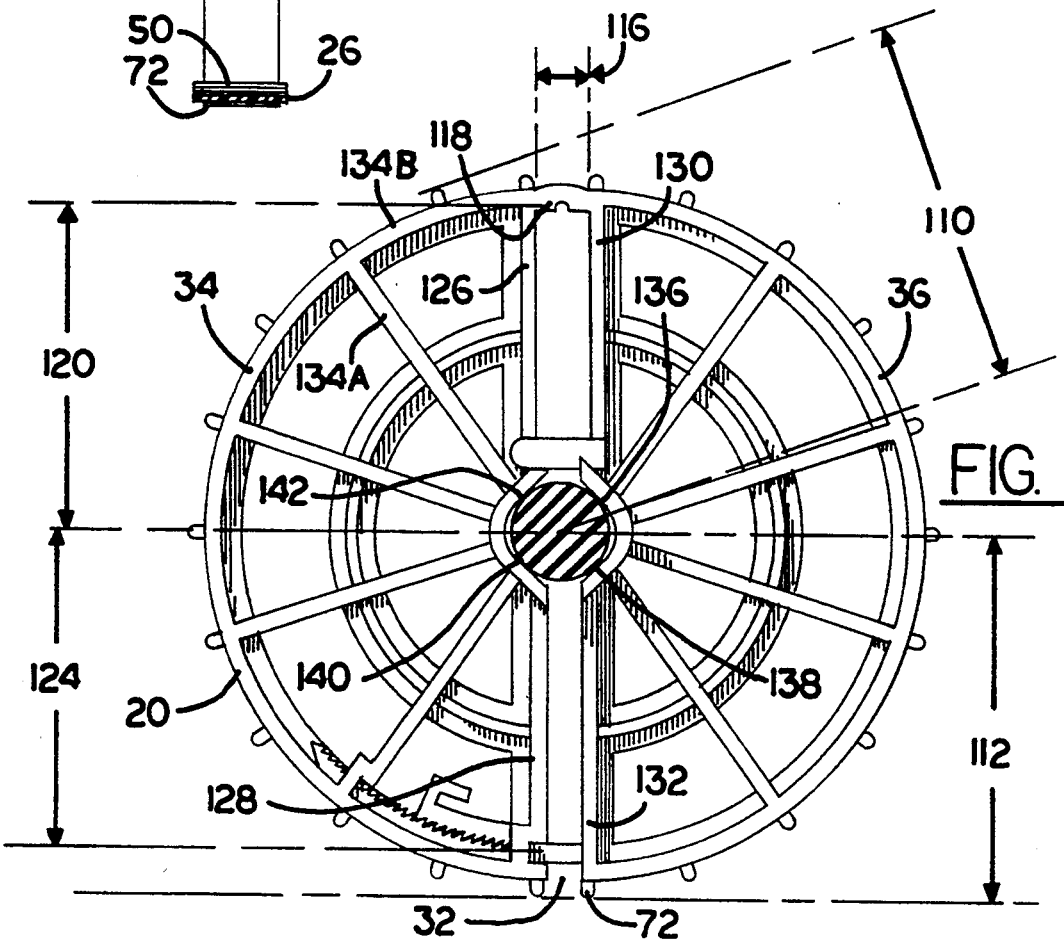
FIG. 7 is a side elevational view of the spacer of FIG. 2, fastened about a rod.

FIG. 7 shows spacer 20 locked on the rod. As the spacer is shown oriented in FIG. 5, the rod is gripped by the saddles by contact with the rod at four locations, 136, 138, 140, and 142, around its circumference, at approximately 45, 135, 225, and 315 degrees respectively. This holds the spacer perpendicular to the rod and keeps it from cocking from that position during pouring of concrete on the rod and spacer.

As the saddles lifted the rod from the fingers, acquired and closed on the rod, the inner curves of the saddles realigned the spacer so that the rod is held at the symmetrical center of the spacer. Distances 110 and 112 representing the distance from the center of the rod to a mold wall are about the same, regardless of rotational position of the spacer on the rod.

Sections 34 and 36 preferably are spaced 116 from one another by rim extensions 118 to provide a more uniform clamping action on the various diameter rods that the spacer is designed to receive.

Uniformity of clamping about the rod is further enhanced by the hinge and the drawing force of the ratchet being at the periphery of the spacer, with the rod at the fulcrum of two long leverage arms 120 and 124 thus formed respectively by the distance of the hinge and ratchet from the rod provided by arms 126, 128, 130, and 132. The strong plastic sections yield slightly over the length of the leverage arms to permit better fit to the rod without undergoing excessive strain and being damaged.

Opening 32 is small and has little if any effect upon distance from the rod to the wall. In order to further minimize the effect of opening 32 upon contact with a wall, a rib 72 is located at each edge of the opening.

It is clear from the above description that the objects of the invention are met. Installation of this inexpensive spacer on any one of a variety of size rods is simple and quick, without concern about angle of rotation on the rod. It is slipped on the rod from any angle of rotation until it comes to a stop, then squeezed shut. The spacer self aligns to center the rod, locks on perpendicularly, and is resistant to cocking.

While the present invention has been described with respect to details of a preferred embodiment thereof, it will be understood that other embodiments and modifications thereof are contemplated by the inventor. For example, an arm which extends from a saddle to the top of the spacer may be straight as in 126, or may be L shaped as in right turn arm **134*a*-134*b***.

It will be obvious to those skilled in the art that various modifications and substitutions may be made without departing from the spirit and scope of the invention as set forth in the following claims.

I claim:

1. A spacer for mounting on a reinforcement rod used in concrete item manufacture for spacing said rod from an object, said spacer having a top, a bottom, and comprising:

a first saddle having a first front side and a first back side, a second saddle having a second front side, a second back side, said first and second front sides being for clamping the rod between them for said mounting of said spacer on said rod, a first arm attached to said first saddle and extending from said first saddle to the top of said spacer, a second arm attached to said second saddle and extending from said second saddle to the top of said spacer, and hinge means connecting said first and second arms at the top of said spacer for pivoting said first saddle to said second saddle on said hinge means, a third arm attached to said first saddle and extending away from said first arm, a fourth arm attached to said second saddle and extending away from said second arm, means for resisting separation of said third and fourth arms, spaced from said saddles and attached to a one of said third and fourth arms.

2. The spacer described in claim 1, further comprising:

first rim means, attached to said first and third arm and having a shape in which it is spaced away from said first back side of said first saddle for spacing said first saddle from said object.

3. The spacer described in claim 2, further comprising:

second rim means, attached to said second and fourth arm and having a shape in which it is spaced away from said second back side of said second saddle for spacing said second saddle from said object.

4. The spacer described in claim 3, further comprising:

said first and second rim means forming approximately a wheel when said first and second saddles are clamped on a rod.

5. The spacer described in claim 1, further comprising:

finger means mounted on said spacer between said hinge means and a one of said first saddle and said second saddle, for preventing movement of a rod past the saddle to said hinge means.

6. The spacer described in claim 1, further comprising:

guide means mounted on said spacer between said hinge means and a one of said first saddle and said second saddle, for positioning the center of a rod between said first and second sides when said saddles are pivoted away from one another.

7. A wheel spacer for mounting on a reinforcement rod used in concrete item manufacture, for spacing said rod from an object, said spacer comprising:

a first section having an inner side, a semicircular outer side, a first end, and a second end, hinge means, a second section having an inner side, a semicircular outer side, a first end, and a second end, said second section being pivotally attached at said first end by said hinge means to the first end of said first section, said spacer being a generally uniformly circular wheel formed by the outer sides when said sections are brought together, said first and second sections comprising saddle means at their inner sides for gripping a reinforcement rod at the center of the wheel when said sections are brought together on the rod, so that distance from the rod to an object against which said wheel rests is approximately the same regardless of the rotational position of said wheel spacer on the rod, essentially stiff means for spacing, connected to said saddle means and said inner sides, for spacing said saddle means from said inner sides.

8. Said wheel spacer described in claim 7, further comprising:

guide means mounted on said means for spacing between said saddle means and said hinge means for positioning the center of a rod between said inner sides of said first and second sections when said first and second sections are pivoted away from one another.

9. Said one-piece molded wheel spacer described in claim 7, further comprising:

means, mounted on said spacer for resisting separation of said second ends of said first and second sections.

10. Said wheel spacer described in claim 9, further comprising:

said wheel spacer being of one-piece molded construction.

11. Said one-piece molded wheel spacer described in claim 10, further comprising:

said means for resisting separation comprising a ratchet assembly comprising a ratchet arm on one of said first and second sections and receiving ratchet means on the other section for engaging said ratchet arm, and means on said ratchet assembly for separating said ratchet arm from said receiving ratchet means for disengaging said means for resisting separation.

* * * * *